US006132142A

United States Patent [19]

Carmichael

[11] Patent Number: 6,132,142

[45] **Date of Patent: *Oct. 17, 2000**

[54] DROP WEIGHT DIVE BELT

[76] Inventor: Robert M. Carmichael, 2124 NE. 24th St., Wilton Manors, Fla. 33305

[ * ] Notice: This patent is subject to a terminal disclaimer.

[21] Appl. No.: 09/071,583

[22] Filed: May 1, 1998

Related U.S. Application Data

[63] Continuation of application No. 08/560,329, Nov. 17, 1995, Pat. No. 5,746,542.

[51] Int. Cl.[7] ..... B63C 11/30

[52] U.S. Cl. ..... 405/186; 224/934

[58] Field of Search ..... 405/186, 185; 441/96, 90, 106; 482/105; 224/681, 937

[56] References Cited

U.S. PATENT DOCUMENTS

| | | | |
|---|---|---|---|
| 3,470,570 | 10/1969 | Christiansen | 405/186 |
| 3,536,071 | 10/1970 | Ferrando | 441/76 X |
| 4,623,316 | 11/1986 | Ratliff | 441/106 |
| 4,732,305 | 3/1988 | Courtney et al. | 405/186 |
| 4,887,932 | 12/1989 | Toth | 405/186 |
| 4,919,631 | 4/1990 | Stafford | 405/186 X |
| 5,205,672 | 4/1993 | Stinton | 405/186 |
| 5,516,234 | 5/1996 | Duchesne | 405/186 |
| 5,641,247 | 6/1997 | Seligman | 405/186 |
| 5,746,542 | 5/1998 | Carmichael | 405/186 |

*Primary Examiner*—David Bagnell
*Assistant Examiner*—Frederick L. Lagman
*Attorney, Agent, or Firm*—Malin, Haley & DiMaggio, P.A.

[57] ABSTRACT

A dive belt is provided for use by divers during underwater activities, such as scuba diving. The belt comprises a body member and a rapid release weight system which is quickly removal while the belt remains in place on the diver. The belt can also provide for horizontally mounted supplemental air supply system, for use in the event a main air supply is lost or not wanted. An elastic depth compensator can be built into the belt, insuring a snug fit of the belt at any depth. The belt has a plurality of D rings for convenient equipment management. A quick release tow clip is attached to the belt and may be used in conjunction with a surface air supply system for pulling the surface air supply system.

16 Claims, 8 Drawing Sheets

400
402
410
316
340
606
604
622
620
612
608
411
414
406
404
600
602
603
610
624

DROP WEIGHT DIVE BELT

This application is a continuation of application Ser. No. 08/560,329, filed Nov. 17, 1995 now U.S. Pat. No. 5,746, 542.

BACKGROUND OF THE INVENTION

1. Field of the Invention

The present invention relates to a belt for underwater diving and more particularly to a belt having weights attached for use by underwater divers. The weights are used by divers to overcome the buoyancy force of water.

2. Description of the Prior Art

Belts for underwater diving have been known and used for many years. These belts have been effective in overcoming the buoyancy associated with diving. This buoyancy force makes it difficult for divers to ascend. However, there are situations experienced while diving when the diver needs to access the surface of the water quickly. In which case, the diver needs to rid him or her self of the extra weight associated with the weight belt. This has been done in the past by dropping the entire weight belt. Thus the diver would lose the belt and any equipment attached to it that was not removed before releasing the belt.

Since the belt is only dropped in an emergency, speed of weight removal is essential. Therefore, dive belts containing individual pockets of weight also have to be removed entirely as time may be of the essence, thus not allowing for the individual pockets to be emptied.

Accordingly, prior dive belts have to be removed entirely in the event of an emergency. These belts often are utilized to carry other equipment, thus in the event of an emergency, both the belt and the equipment are discarded, resulting in not only a loss of the dive belt but also the attached equipment. Hence, if emergency situations occur often and require the weight belt and attached equipment to be lost, the enjoyment and participation in the sport of scuba diving may be prohibited to certain divers due to cost considerations.

Furthermore, because the belt may have to be dropped, it could not be used to attach a supplemental air supply system. In that case, the supplemental air supply system must be mounted on the diver separately from the belt causing additional encumbrances during normal dive conditions.

Of particular interest in pointing out some of the prior art limitations with previous dive belts are the following U.S. patents.

U.S. Pat. No. 5,337,935, issued to B. Chanbonnet, is for a belt structure, particularly for accessories thereto. The Chanbonnet reference discloses a belt structure for carrying dive equipment which comprises a closure strap having at least one free portion on the surface of which are secured at least two first securement elements in the form of loops. The second securement is carried by a wing of a substantially rigid dorsal carrying element, so as to modify the effective length of the free portion according to different sizes of the user. The belt structure disclosed is provided to overcome the problems associated with different size users of a belt. Thus, this invention allows divers of various sizes to use the same belt. However, for divers to free themselves of the weight of this belt, it is necessary to remove the entire belt.

U.S. Pat. No. 4,732,305, issued to W. L. Courtney, is a weight belt for underwater diving. The Courtney reference discloses a weight belt for underwater diving wherein the belt is provided with elongated panels for interconnecting pockets for receiving and containing dive weights. The panels being interconnected by one or more belt portions and adjustable buckles or the like for positioning the panels about the diver's waist are permitting them to be adjustably positioned in centered relation on the diver's hips. The panels are preferably formed with multiple pockets facilitating arrangement about the diver's hips. The lower edge of each panel also has a configuration for conforming with the diver's hips. This invention provides a weight belt which is adaptable for divers of different sizes and configured to greatly enhance a diver's comfort. Furthermore, D-rings can also be provided with the weight belt for attaching accessories such as flashlights, cameras, etc. to the weight belt. However, for a diver to get rid of the weight, the entire belt needs have to be removed. Therefore, any accessories attached to the said D-rings are also dropped with the belt.

Other references, such as U.S. Pat. No. 4,440,525, issued to H. L. Perla, U.S. Pat. No. 3,713,299, issued to D. B. Duncan and U.S. Pat. No. 3,374,636, issued to D. F. Mason all pertain to diver's weight belts. These references like the ones mentioned above all suffer from the same limitation, which is that they must be removed entirely in order to get rid of the weights.

Thus what is needed in the art is a dive belt having removable weight members, which can be discarded without removing the entire dive belt. It is therefore, to the effective resolution of the aforementioned problems and shortcomings that the present invention is directed.

SUMMARY OF THE INVENTION

The present invention generally discloses a dive belt constructed for quick removal of preferably a pair of weights, associated with the belt, in the event of an emergency. The belt remains in place and is not discarded as the weights are quickly and easily dropped. Thus, a diver can access the surface quickly, without worrying about the typical problems associated with dropping the entire weight belt. The invention also allows the weights to be dropped by the simple procedure of pulling a rip cord to free the weight contained in a pouch which is normally housed within a pocket secured to the belt. The invention further allows the attachment of a supplemental air supply system. The air supply system is positioned on the belt, horizontally across the diver's back such that a standard dive tank could be worn in conjunction with the supplemental air system. This mounting configuration of the supplemental air system has the advantage of greater mobility for the diver when wearing the present invention.

The supplemental air system could also be utilized as a primary tank for short duration dives so that a standard tank system which is typically much larger and separately mounted on a diver's back would not be needed.

The invention is constructed to allow the belt to contract when a diver reaches superior depths. As a diver ascends in water, compression decreases the diver's waist size and an elastic depth compensator of the present invention allows the belt to contract with the diver's waistline, insuring proper fit at any depth.

Finally, the invention as described below, allows for operation in conjunction with the surface air supply system. The hose that typically runs from a surface air supply system is attached to the belt and then used by the diver through a mouthpiece. In past use, the hose would go from the air supply system directly to the diver's mouthpiece. This configuration suffers the problem of the hose tugging directly on the mouthpiece being utilized by the diver. By attaching the hose to the dive belt, any tugging occurs at the waist of the diver. Therefore, the present invention can alleviate the discomfort of mouthpiece tugging and stop the mouthpiece from being dislodged altogether.

It is the primary objective of this invention to provide a belt with an integrated weight system, balanced for proper trim and with in either hand, quick ditch system, to release the weight system quickly and easily, while allowing the belt to remain in place.

It is also an object of the invention to provide a belt that is less costly to use in scuba diving by preventing the need to discard the belt and any equipment attached thereto in the event of an emergency.

It is also an object of the invention to provide a belt that is less costly to use in scuba diving by allowing the belt to be reused after dropping weights by securing new weights to belt.

It is an object of the invention to provide a belt that can be used for attaching equipment and providing a management system for managing said attached equipment and air hoses. The equipment and management system will not discarded with the weights in the event of an emergency.

Another object of the invention is to allow attaching a piece of equipment known as a supplemental air system. The supplemental air system is a small tank that is positioned horizontally on the belt across a diver's back, allowing for increased mobility.

In accordance with these and other objects which will become apparent hereinafter, the instant invention will now be described with particular reference to the accompanying drawings.

BRIEF DESCRIPTION OF THE DRAWINGS

The invention may be better understood by reference to the drawings in which.

DESCRIPTION OF THE PREFERRED EMBODIMENTS

Figure 1A:
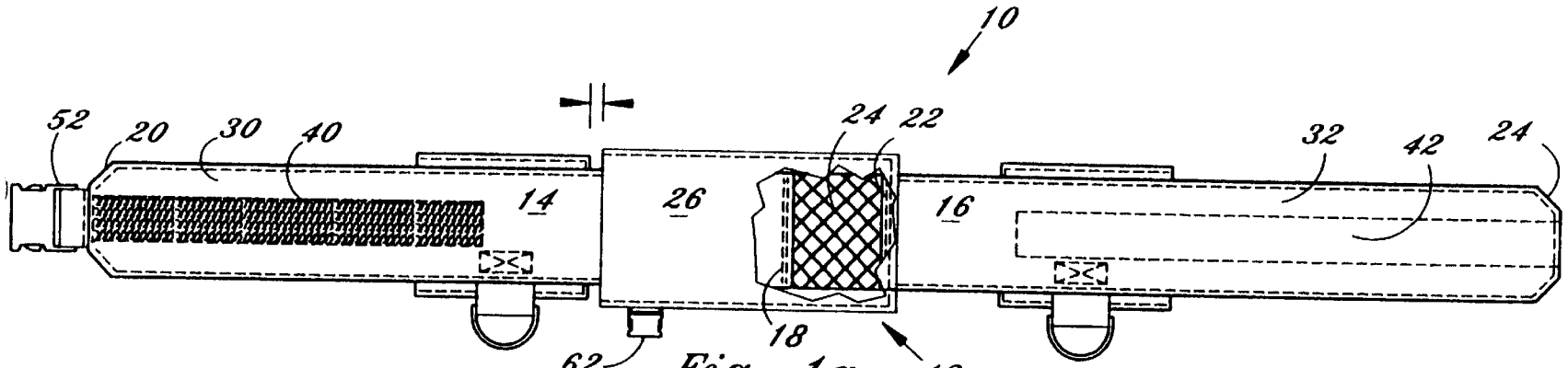
FIG. 1*a* is front elevational view of the interior side of a dive belt in accordance with the present invention having an elastic section in a relatively unexpanded position.

As seen in FIGS. 1 through 4, a first embodiment of the removable weights dive belt is generally shown at 10. Belt member 10 includes a body member 12 having a first main section 14 and a second main section 16. First section 14 includes a hidden first end 18 and an exposed second end 20, while second section 16 includes a hidden first end 22 and an exposed second end 24. Hidden first ends 18 and 22 are conventionally attached to respective ends of an elastic section 24 so that elastic section 24 is interposed between sections 14 and 16. Sections 14 and 16 and elastic section 24 are collinear and form or define the circumference of dive belt 10, when wrapped around a diver's waist when in use. Hidden first ends 18 and 22 and elastic section 24 are disposed within a sleeve member 26. Sections 14 and 16 and sleeve member 26 can be constructed from conventional materials commonly used in making dive belts.

End 22 is also attached to an adjacent portion of sleeve member 26 by conventional means such as sewing or stitching. Thus, second main section 16 remains in a fixed or permanent position, and first main section 14 is slidable or movable in conjunction with the stretching or contracting of elastic section 24.

Figure 1B:
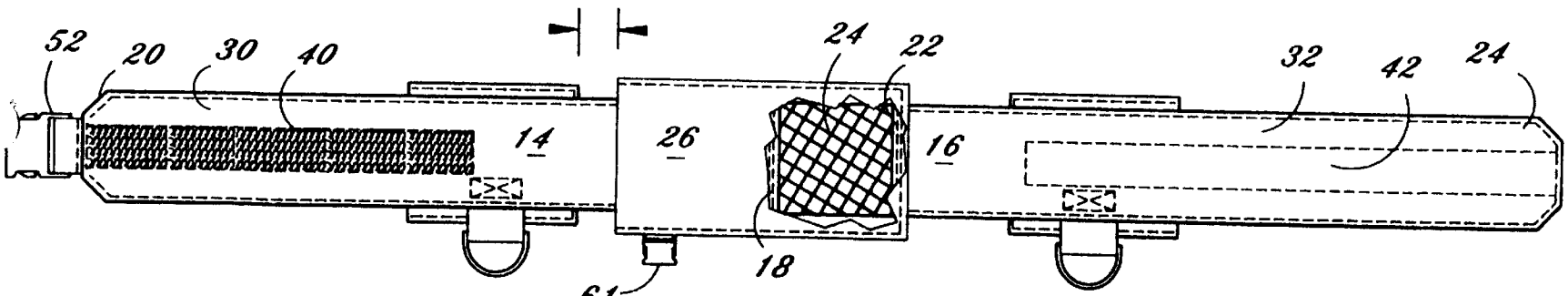
FIG. 1*b* is front elevational view of the interior side of a dive belt in accordance with the present invention having an elastic section in a relatively expanded position as compared to FIG. 1*a;*
Figure 2:
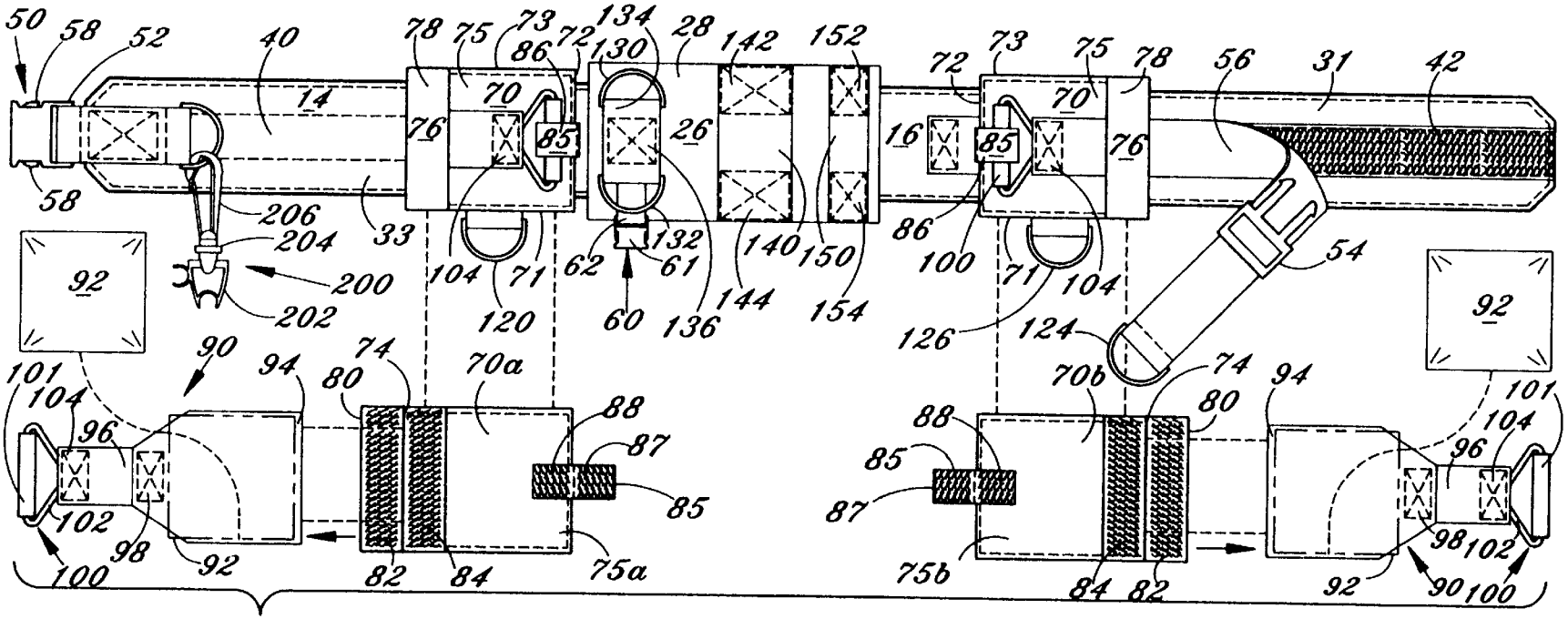
FIG. 2 is a front elevational view of the exterior side of the dive belt of FIG. 1, including breaking views of the removable weight means and pocket members in accordance with the present invention.
Figure 3B:
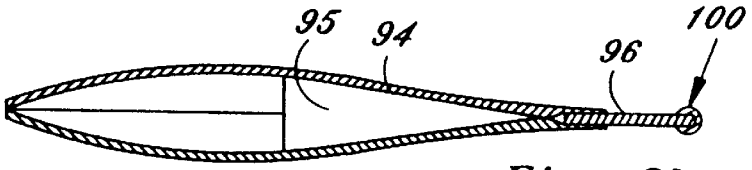
FIG. 3*b* is a sectional view of the removable weight member of the present invention having the removable weight bag removed in accordance with the present invention.
Figure 3A:
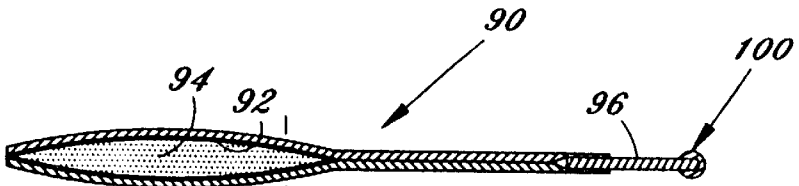
FIG. 3*a* is a sectional view of the removable weight member of the present invention having the removable weight bag disposed within in accordance with the present invention.

Elastic section 24 allows for the reduction is circumference size of belt 10 when a diver, wearing belt 10, reaches superior depths. Thus, at superior depths, elastic section 24 contract with the diver's waistline, insuring proper fit at any depth. FIG. 1*a* illustrates elastic section 24 in a contracted position, while FIG. 1*b* illustrates elastic section 24 is a relatively stretched position, as compared to FIG. 1*a*.

First section 14 has an interior surface 30 and an exterior surface 33, while second section 16 has an interior surface 32 and an exterior surface 31. Interior surfaces 30 and 32 are adjacent to the diver's body when dive belt 10 is properly positioned on the diver. Dive belt 10 is provided with means for removably connecting generally sections 14 and 16 together and more particularly end 20 of section 14 with end 24 of section 16. In the preferred embodiment, a took and loop fastenings means 40 and 42 (VELCRO strips) are provided along the interior surface 30 of section 14 and the exterior surface 31 of section 16, respectively. VELCRO strip 40 can be substantially centered on first section 14 extending axially along a portion of first section 14. Similarly, VELCRO strip 42 can be substantially centered on second section 16 extending axially along a portion of said second section 16. Fastening means 40 and 42 provide an adjustable interlock for snugly securing and wrapping dive belt 10 around a diver's waist.

In addition to fastening means 40 and 42, a conventional adjustable quick release clip member 50 is provided, having a female clip receptacle 52 associated with end 20 of section 14 and a male insertion member 54 associated with end 24 of section 16. However, it is to be understood that the positions of receptacle 52 and insertion member 54 could be reversed and such is within the scope of the invention. Insertion member 54 is received within receptacle 52 and locked by conventional means to help further properly secure dive belt 10 around the waist area of the diver, particularly in the event that fastening means 40 and 42 become disconnected from each other. Insertion member 54 can be released from its locked position, by the depression of flange members 58 protruding from and associated with female receptacle 52. Insertion member 54 is adjustable to be properly sized with respect to the diver. To achieve adjustability, insertion member 54 is slidably mounted along an exterior strap 56 attached to section 16. Insertion member 54 is slidably mounted also to accommodate maximum and minimum overlap of fastening means 40 and 42.

Figure 4:
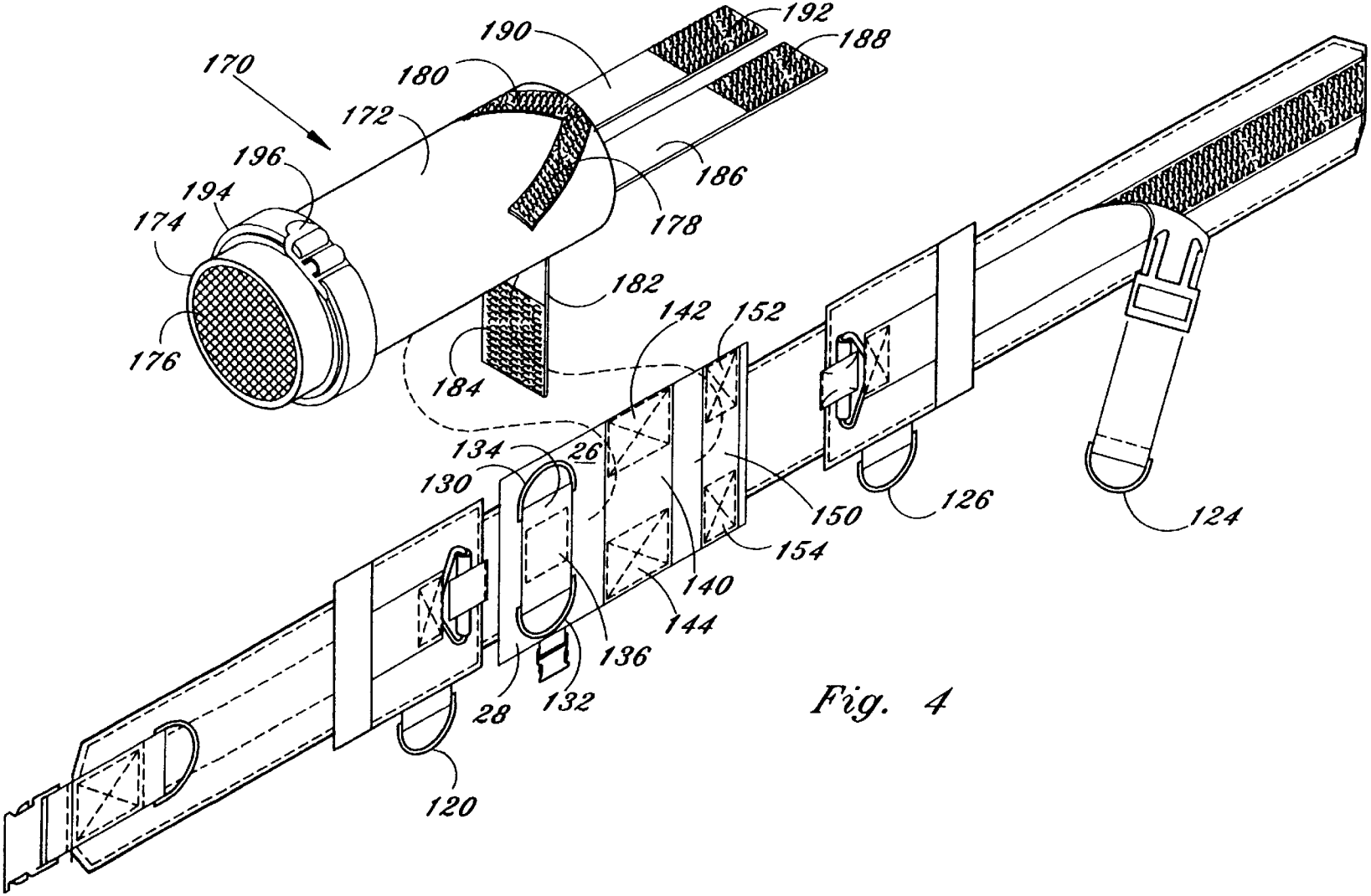
FIG. 4 is a perspective view, without depth, of the dive belt in accordance with the present invention, showing the horizontally mounted sleeve member exploded off from the dive belt.

The exterior surface 28 of sleeve member 26 also provides a supplemental air supply mounting area for horizontally mounting a compressed gas cylinder, including, but not limited to an oxygen tank, or a tank having a mixture of nitrogen and oxygen or a mixture of helium and oxygen. The horizontal mounting of the compressed gas cylinder provides the diver with greater mobility. As seen in FIG. 4, a flexible tank receiving sleeve member 170 is provided having a body member 172 and an open end and a closed end 174. Closed end 174 can be provided with a vent member 176. Strap members 182, 186 and 190 are attached to body member 172 by conventional means such as stitching. Strap members 182, 186 and 190 are provided with hook and loop fastening means 184, 188 and 192, respectively, on their respective inside surfaces. Body member is provided with hook and loop fastening strips 178 and 180 for mating with hook and loop fastening means 190 and 188, respectively, to securely retain a compressed gas cylinder (not shown) within body member 172. A third hook and loop fastening member (not shown) is provided on body member 172 for mating with hook and loop fastening means 184 of strap 182. A tightening strap 194 is attached at near its first end to body member 172 by conventional means, such as stitching, and has its first end sewn to its to form a loop which is attached to a first rod portion of a strap guide member 196. The first end of strap 194 is inserted through guide member 196 and around the first rod portion prior to sewing or stitching the first end of strap 194 to itself. Strap 194 is provided for tightening at least a portion of body member 172 around the compressed gas cylinder disposed within body member and also serves to help horizontally mount tank receiving sleeve member 170 to sleeve member 26, which will be discussed below. Strap 194 can also be provided with a hook and loop fastening member disposed at the unattached end of strap 194 for mating with a hook and loop fastening member disposed along a portion of strap 194 intermediate the attached and unattached ends of strap 194. Before attaching strap 194 to body member 172, strap 194 is inserted through d-ring 130.

Sleeve 26 has a first strap 134 attached to outside surface 28, near the first end of sleeve member 26, by conventional means such as stitching 136 to provide loops at each of strap 134 for securely retaining rings 130 and 132. Preferably, rings 130 and 132 are conventional D-rings. A second strap 150 is attached to outside surface 28 near its opposite second end, by conventional means such as stitching 152 and 154 and defines a first strap passageway between stitching 152 and 154. A third strap 140 is attached to outside surface 28 intermediate straps 134 and 150, by conventional means such as stitching 142 and 144 to define a second strap passageway.

After being attached to guide member 196 and body member 172, the unattached end of strap 194 is inserted through d-ring 132. Strap 194 is then inserted through guide member 196, intermediate the attachment of the first end of strap 194 to guide member 196 and the first end of guide member. Strap 194 is then folded over the first end of guide member 196 and inserted through d-rings 130 and 132. Strap 194 is then inserted through guide member 196, thus tightening at least a portion of body member 172 over the compressed gas cylinder, and folded over a second rod portion of guide member 196 and inserted back through guide member for the mating the hook and loop fastening means of strap 194. The rod portion of guide member is disposed intermediate the second end of guide member 196 and the attachment of the first end of strap 194 to guide member 196. Thus, at this point closed end 174 of body member 172 is attached to sleeve member 26.

Preferably, after the attachment of closed end 174, strap 182 is inserted through the strap passageway of strap 140 and attached back to body member 172 by mating hook and loop fastening means 184 with the hook and the third (not shown) hook and loop fastening means of body member 172. Lastly, straps 186 and 190 are inserted through the strap passageway of strap 150, then crossed over each other and attached back to body member 172, having the compressed gas cylinder disposed within, by mating hook and loop fastening means 188 of strap 186 with hook and loop fastening strip 180 and by mating hook and loop fastening means 192 of strap 190 with hook and loop fastening strip 178, to securely retain the compressed gas cylinder with body member 172.

A quick release tow clip 60 can be provided and, preferably, includes a female receptacle 61 disposed at and attached to mounting exterior surface 28 via a strap 62 and stitching and a male insertion member (not shown) associated with a surface air system. Tow clip 60 is used to harness and tow the surface air system which is providing a source of oxygen to the diver through an air supply line. Clip 60 can be structurally similar to clip 50 and also operates similar. Furthermore, a clip 200 can be provided and can be attached by conventional means, such as swivel and hook assembly 204 and 206 to any of the rings of belt 10. Clip 200 also includes an air tube or air hose connection piece 202 for removable attachment of a portion of the air hose (not shown). A second air hose connection piece can be provided for the air hose associated with horizontally mounted compressed gas cylinder. Thus, when moving the surface air system, any tugging takes place at tow clip 60 and possibly clip 200, preventing tugging of the diver's mouthpiece which is connected to the air hose and is also associated with the surface air system. In lieu of the surface air system, the diver can utilized the horizontally mounted compressed gas cylinder, discussed above, normally providing a secondary source as its primary source.

Dive belt 10 is provided with at least one pocket member 70 for the receipt of a quick release weight means 90. Pocket member 70 is attached to dive belt 10 by conventional means such as stitching or sewing. Preferably, two pocket members 70 and associated quick release weight means 90 are provided. A first pocket member 70 being attached to exterior surface 33 of first section 14, preferably at its backside and a second pocket member 70*b* attached to exterior surface 31 of second section 16, preferably at its backside. Pockets 70 are preferably sewn closed along three sides, while having an open end 74 for the receipt of respective quick release weight means 90, discussed in detail below.

A first flap member 76 is attached to pocket member 70 at open end 74. Flap member 76 includes an outer surface 78 and an inner surface 80. First flap closing means can be provided and preferably comprises hook and loop fastening means 82 and 84 attached to inner surface 80 of flap member 76 and an outer surface 75 (adjacent open end 74) of pocket member 70, respectively. A relatively smaller second flap member 85 having an inner surface and an outer surface 86 can be provided near or at closed end 72 of pocket member 70. Flap member 75 is provided to house a handle means 100, when not in use. Though flap member 85 is preferably provided at end 72, other locations along belt 10 or pocket member 70 are within the scope of the invention. Second flap closing means can be provided and preferably comprises hook and loop fastening means 87 and 88 attached to the inner surface of flap member 85 and an outer surface 75 (adjacent a portion of closed end 72) of pocket member 70, respectively.

Quick release weight means 90 includes a weight member or bag 92, weight receiving pouch member 94 connected to a handle means 100. Handle means 100 can include a small strap member attached to one end to pouch member 94 by conventional means such as stitching 98 and a triangular shaped gripping member 102 having a gripping surface 101. Gripping member 102 is attached to the opposite end of strap 96 by conventional means such as stitching 104. Bag member 92 can contain any conventional materials utilized for providing weight such as sand, concrete, beads, marbles, etc.

In non-emergency underwater situations, bag member is disposed within area 95 of pouch member 94 and pouch member is disposed within its respective pocket member 70. Pouch 94 is disposed within pocket 70 such that the open end of pouch 94 is directed toward flap 76. When properly disposed strap 96 protrudes out of pocket member 70. To maintain pouch 94 within pocket 70, strap 96 is folded over, followed by folding over flap 76 to allow hook and loop fasteners 82 and 84 to mate, thus, securely retaining pouch 94 within pocket 70. To provide addition securement, flap 85 is inserted through handle member 100 and folded over a portion of gripping surface 101 to allow hook and loop fasteners 87 and 88 to mate. This additional securement also prevents straps 96 from hanging or dangling, which could bother the diver or inadvertently cause pouch 94 to be removed from pocket member 70.

In an emergency situation, where the diver needs to quickly rise to the water's surface, the present invention allows the diver to rapidly remove one or both weight means 90 from belt 10 without removing belt 10 from around the diver's waist. To remove weight means 90 the diver grabs handle means 100 at gripping surface 101 and pulls handle means 100 with a normal tugging motion force, first breaking the attachment of fastening means 87 to fastening means 88 and then breaking the attachment of fastening means 82 to fastening means 84, and causing weight means 90 to be rapidly removed from pocket members 70. Once removed, weight means 90 can be dropped by the diver and thus the diver does not lose the entire belt in the emergency situation. Furthermore, if time permits, the diver can remove weight bag 92 from pouch 94 and simply drop weight bag 92, thus only losing weight bag 92 which comprises the majority of the weight of weight means 90.

As seen in the drawings various d-rings can be attached to belt 10 by conventional means and are provided for removably attaching various equipment or articles to belt 10.

FIGS. 5*a* through 5*e* illustrate a second embodiment body member for dive belt 10. In this embodiment, an adjustable body member 300 which includes a fixed section 316, adjustable and removable section 400, attachment section 336 and an elastic member 324 which is disposed within attachment section 336, when belt 10 is properly constructed.

Figure 5A:
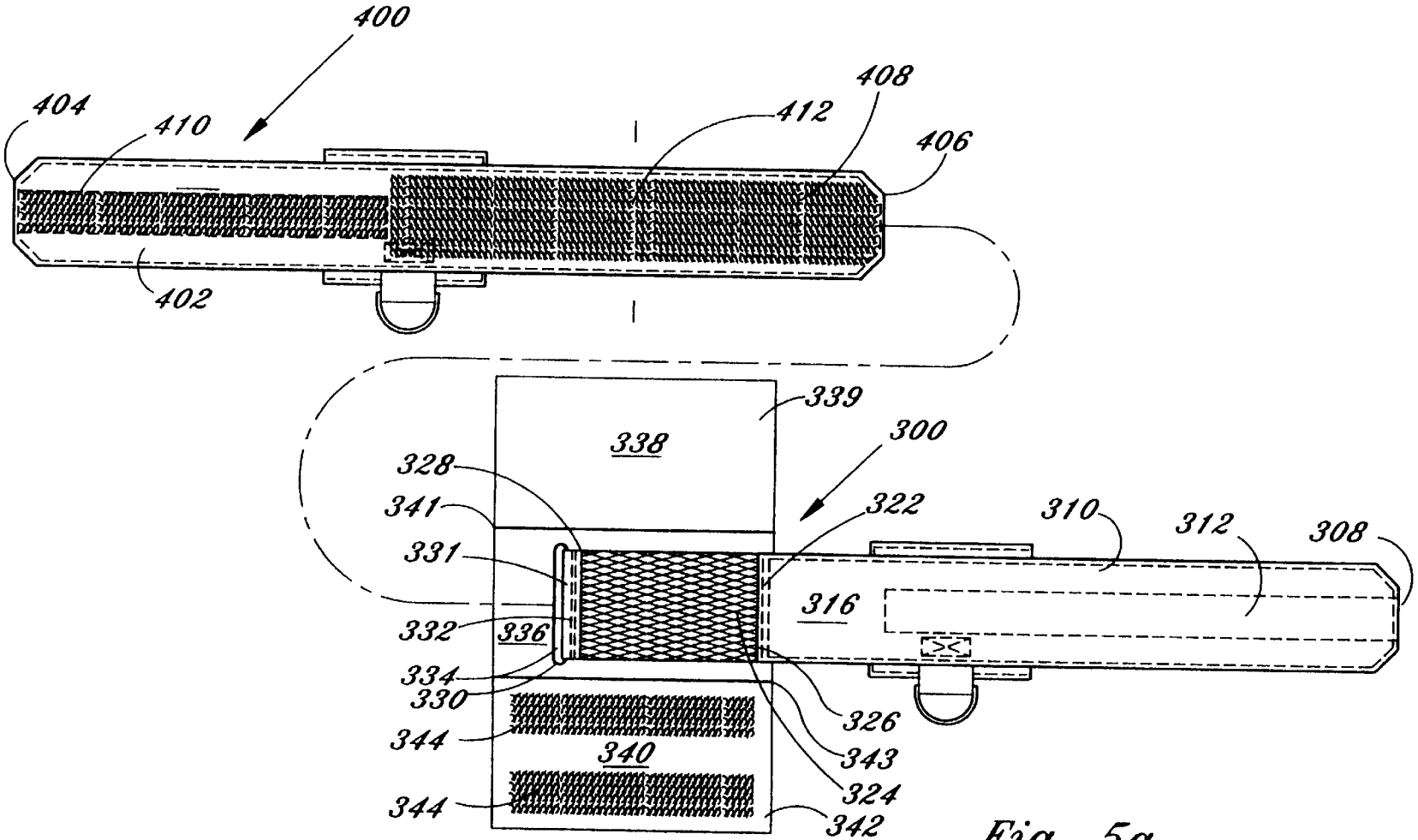
FIG. 5*a* is a front elevational view of the interior side of a second embodiment body member for the dive belt showing the adjustable section of the body member removed from the remaining portion of the dive belt.

As seen in FIG. 5*a* adjustable section 400 has a first end 404 and a second end 406. A first hook and loop fastening means 410 and a second hook and loop fastening means 408 are disposed on a first surface 402 of adjustable section 400. (In lieu of second hook and loop fastening means 408, first hook and loop fastening means 410 can be extended along substantially the entire length of first surface 402 of adjustable section 400, see FIG. 8). Padding can be provided within at least the portion of adjustable section 400 which is adjacent first hook and loop fastening means 410 (FIG. 5*a*). Furthermore, the portion of adjustable section 400 which is adjacent hook and loop fastening means 408 can have its outer edge slightly taper to end 406, to help hide this portion of the adjustable section behind the remaining portion of the adjustable section, when the adjustable section is properly attached, as well as allowing the tapered portion to be more easily inserted through strap passageway 334, described in detail below.

Fixed section 316 has an exposed first end 308 and a second end 322 which is secured to attachment section 336 by conventional means such as stitching. Elastic section 324 has a first end 328 which is also secured to attachment section 336, adjacent fixed section end 322 by conventional means, such as stitching. A loop member 331 is formed at end 328 of elastic section 324, preferably by securing a fabric member to section 324 by conventional means, such as stitching 332. A guide member 330 is retained within loop member 331, and defines an adjustable section passageway 334 between guide member 330 and end 328, for the insertion of end 406 of adjustable section 400. Preferably, guide member 330 is constructed from stainless steel, however, other conventional materials can be utilized and are considered within the scope of the invention.

A first flap member 338, having a first surface 339, is secured to attachment section 336 along a first fold line 341.

A second flap member 340, having a first surface 342, is secured to attachment section 336 along a second fold line 343. Hook and loop fastening means 344 is provided along first surface 343.

Adjustable body member 300 allows divers of various waist sizes to utilize the same dive belt by simply moving adjustable section 400 to allow for a proper fit. For purposes of showing how section 400 is attached to the rest of body member 300, point 412 is selected as the point on adjustable section 400, which section 400 is folded, described above, to provide a proper fit around the diver's waist. However, it should be understood that the selection of this point is not limiting and only selected for example purposes.

Figure 5B:
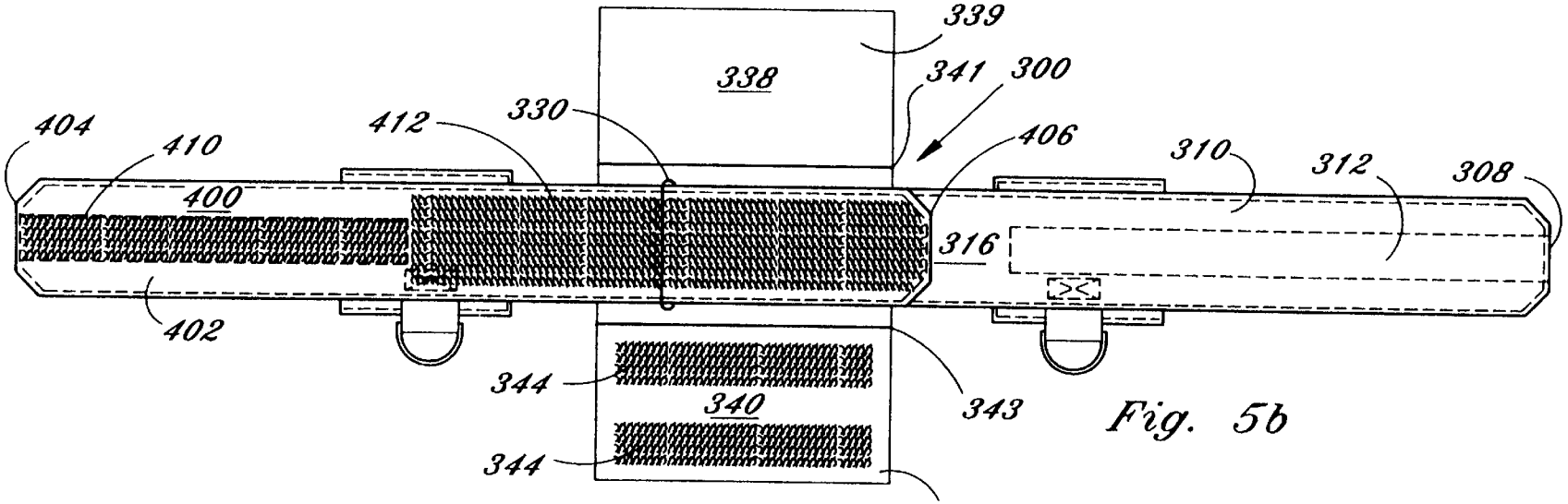
FIG. 5*b* is a front elevational view of the interior side of a second embodiment body member for the dive belt illustrating the first step to attaching the adjustable section of the body member to the remaining portion of the dive belt.
Figure 5C:
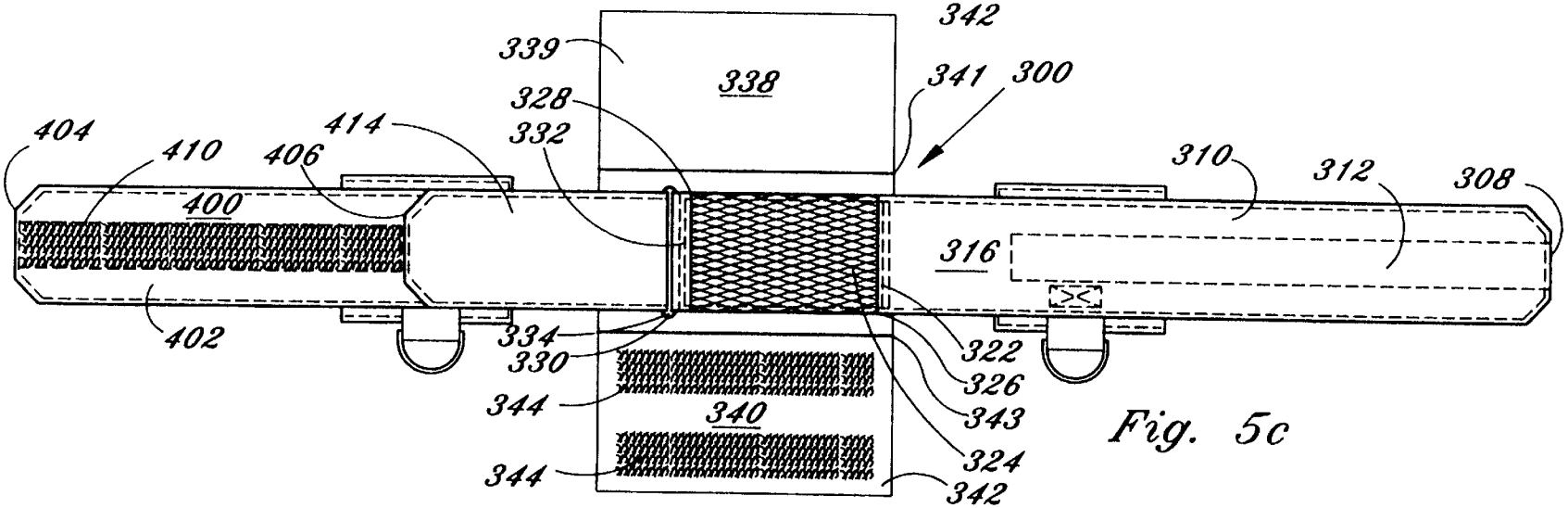
FIG. 5*c* is a front elevational view of the interior side of a second embodiment body member for the dive belt illustrating the second step to attaching the adjustable section of the body member to the remaining portion of the dive belt.
Figure 5D:
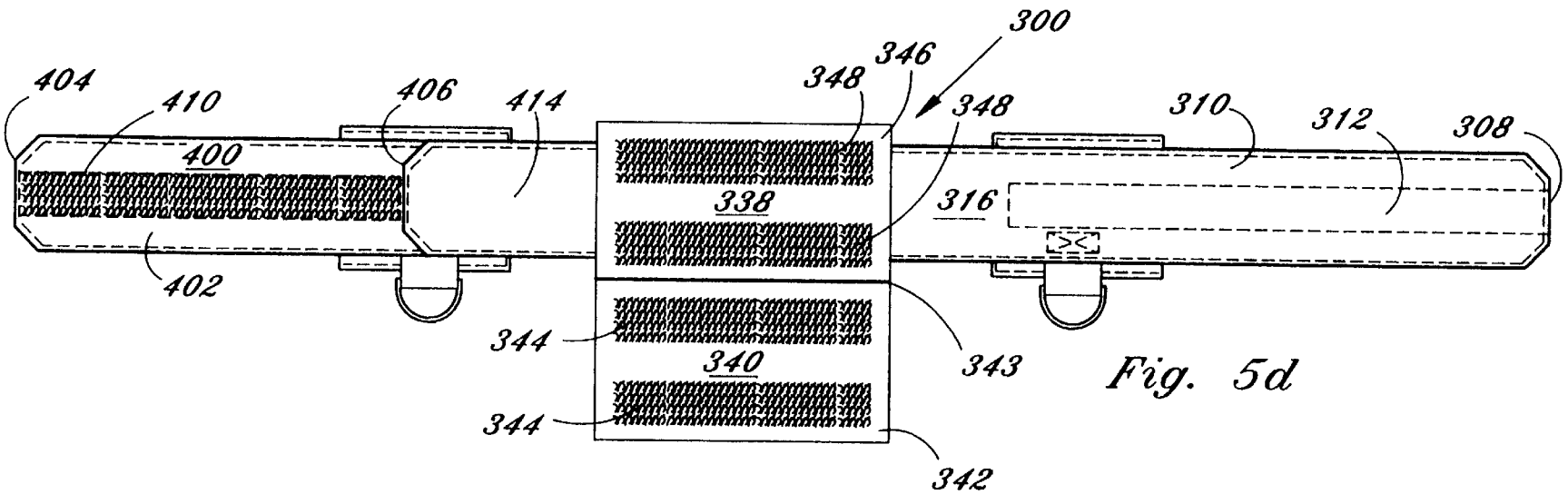
FIG. 5*d* is a front elevational view of the interior side of a second embodiment body member for the dive belt illustrating the third step to attaching the adjustable section of the body member to the remaining portion of the dive belt.
Figure 5E:
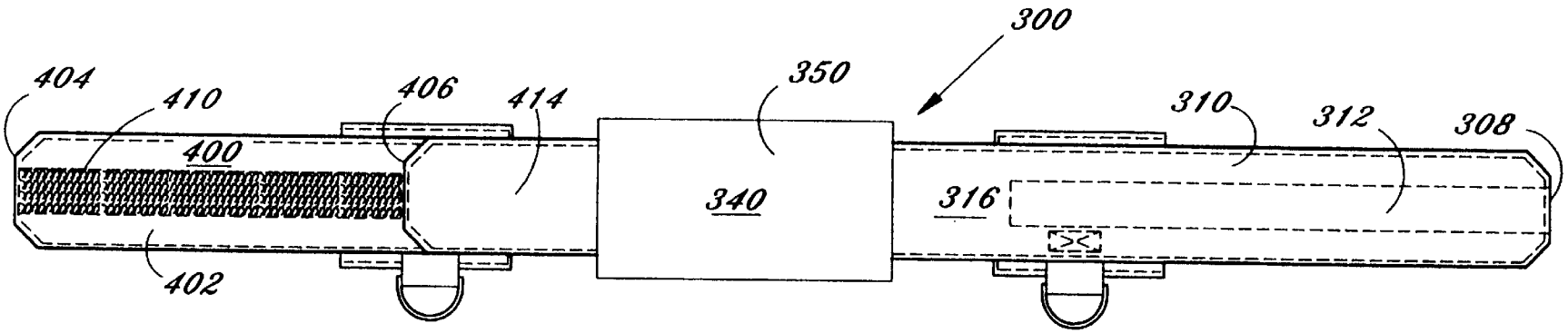
FIG. 5*e* is a front elevational view of the interior side of a second embodiment body member for the dive belt illustrating the fourth step to attaching the adjustable section of the body member to the remaining portion of the dive belt.

As seen in FIG. 5*b*, when attaching section 400 to the rest of body member 300, a portion of section 400, starting from end 406, is inserted within passageway 334, until the desired point 412 is aligned with guide member 330. Once aligned, the inserted portion of is folded over guide member 330, to allow hook and loop fastening means 408 to mate with itself (FIG. 5*c*). FIG. 5*c* also illustrates a portion of a second surface 414 of adjustable section 400. Once the inserted portion is folded over and secured by the mating of hook and loop fastening means 412, flap 338 is folded inward, along fold line 341 (FIG. 5*d*). As seen in FIG. 5*d*, hook and loop fastening means 348 are disposed on a second surface 346 of flap 338, for the eventual mating with hook and loop fastening means 344 of flap 340. Once flap 338 has been folded, flap 340 is folded inward, along fold line 343 (FIG. 5*e*) thus allowing hook and loop fastening means 348 to mate with hook and loop fastening means 344. FIG. 5*e* also illustrates a second surface 350 of flap 340.

It should also be noted that hook and loop fastening means 344 could be disposed on second surface 350 instead of surface 342 and hook and loop fastening means 348 be disposed on surface 339 instead of surface 346. In this situation, the order of folded inward flaps 338 and 340 would be reversed to allow hook and loop fastening means 344 to still mate with hook and loop fastening means 348.

To adjust section 400 to compensate for diver's of larger or smaller waist sizes, the diver merely follows the reverse order as shown in FIGS. 5*a* through 5*e*. Thus, flap 340 is folded outward, along fold line 343, breaking the attachment of hook and loop fastening means 344 and hook and loop fastening means 348. Next, flap 338 is folded outward, along fold line 341. After such, the inserted portion is folded back to the position shown in FIG. 5*b*, thus, breaking the attachment of hook and loop fastening means 412 to itself. Once in the position shown in FIG. 5*b*, adjustable section 400 is repositioned to properly fit the different waist size diver, and then the steps shown in FIGS. 5*c* through 5*e* are performed to securely and safely attach adjustable section 400 to the rest of body member 300.

Accordingly, flaps 338 and 340 help to assure that adjustable section is securely and safely attached to the rest of body member 300, while also providing protection to elastic section 324 and guide member 330. Furthermore, the embodiment of body member 300 shown in FIG. 5, still allows for compensation through elastic section 324, as described above for the first embodiment body member, when the diver dives to significant depths underwater. The rest of the features of the dive belt, not discussed in this second embodiment for the body member of the dive belt, are structurally similar, as well as operating similarly, to like features of the embodiment shown in FIGS. 1 through 4.

Figures 6, 7A, 7B, 7C, 7D, 7E, 7F:
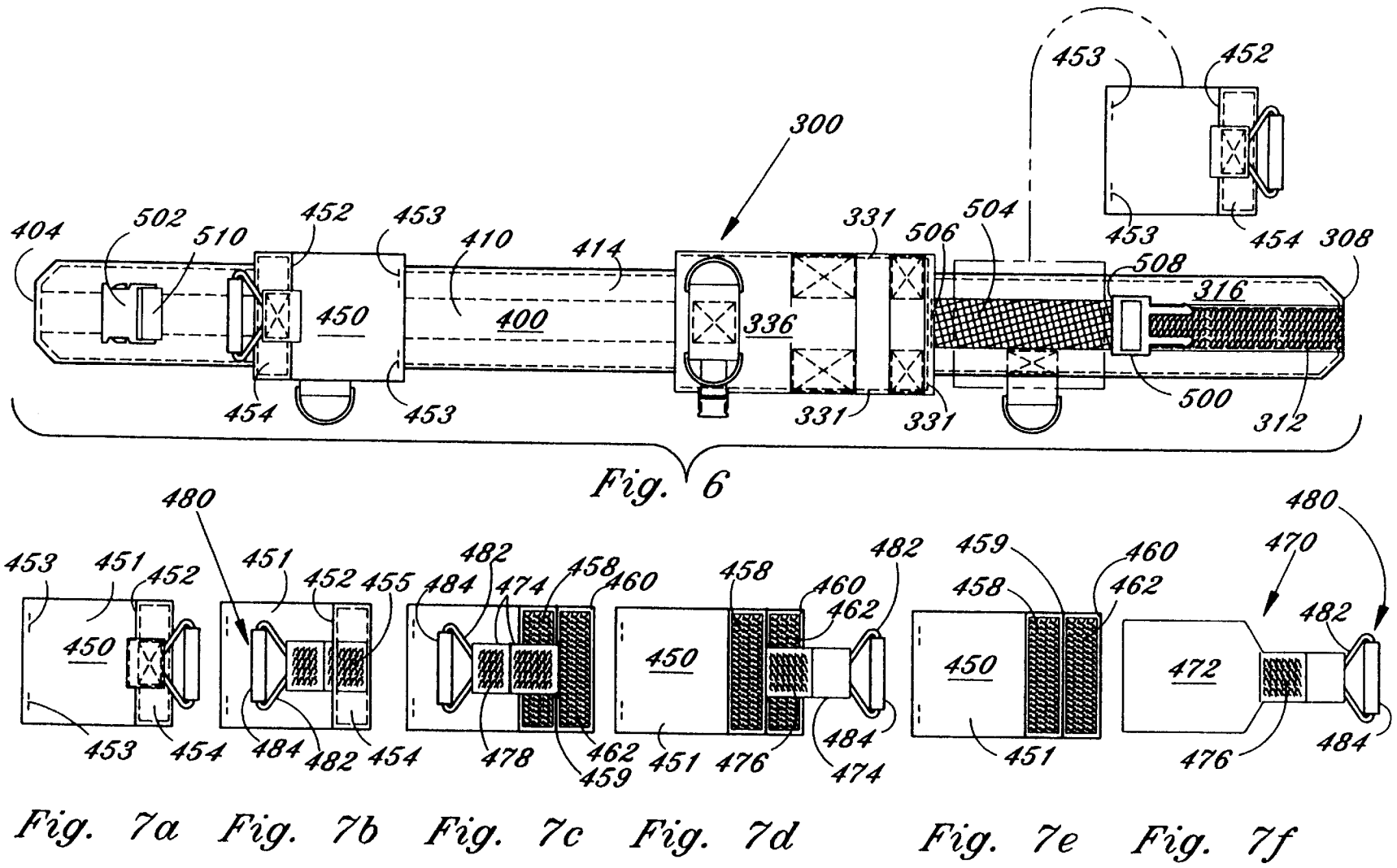
FIG. 6 is a front elevational view of the exterior side of the second embodiment body member for the dive belt also illustrating a second embodiment for the removable attachment of the weight means to the pocket member.
FIGS. 7*a* through 7*f* illustrates the various steps which are performed for rapidly removing the weight means from the pocket member for the second embodiment removable attachment of the weight means to the pocket member.

As seen in FIG. 6, in lieu male insertion member 54 being slidably adjustable along a strap member for mating with female receiving member 52, an elastic strap 504 can be provided having a first end 506 attached to body member 300 adjacent end 322 of fixed section 316 and a second end 508 attached to a male insertion member 500. Male insertion member 500 is similar in structure and operation as insertion member 54 and is inserted within female receiving member 502, attached via a strap means 510 to adjustable section 400. Thus, instead of sliding the insertion member along a strap member elastic section 504 is simply stretched, thus strap member 56 is eliminated. Also seen in FIG. 6, is a second embodiment for the pocket member and is generally designated at 450. One of pocket members 450 is shown removed in FIG. 6 to illustrate elastic section 504. However, pocket members 450 are attached to the respective sections 316 and 400, by conventional means, such as stitching 452.

As seen in FIG. 7*a* through 7*f*, the steps required for removing weight means 470 from pocket member 450 are illustrated, as well as illustrating the structure of pocket member 450 and weight means 470. As seen in FIGS. 7*a* through 7*f*, pocket member 450 is shown having an outer surface 451. A hook and loop fastening means 458 is provided on outer surface 451 adjacent the open end of pocket member 450. A pocket flap member 452 is provided having an outer surface 454 and an inner surface 460. A first flap hook and loop fastening means 455 is provided on outer surface 454 and a second hook and loop fastening means 462 is provided on inner surface 460. Either of the pocket members 70 and/or 450 can be provided with perforated portions.

Weight means 470 includes a pouch member 472, which houses a weight bag or other weight member (not shown but similar to weight bag 92), a strap member 474 and a handle means 480. Preferably, the weight bag is removable from pouch member 472. A hook and loop fastening means 476 is provided on a first surface of strap member 474 and hook and loop fastening means 478 and 480 are provided on a second surface of strap member 474. A first end of strap member 474 is attached to pouch member 472 and a second end of strap member 474 is attached to handle means 480 by conventional means. Handle means 480 includes a triangularly shaped gripping member 482 having a gripping surface 484.

In the normal use of the dive belt, pouch member 472 of weight means 470 is disposed within pocket member 450 with strap member 474 and handle means 480 protruding out of pocket member 472. A portion of hook and loop fastening means 462 mates with hook and loop fastening means 480, hook and loop fastening means 476 mates with a portion of hook and loop fastening means 458, and a remaining portion of hook and loop fastening means 462 mates with a remaining portion of hook and loop fastening means 458, by folding flap 452 inward along fold line 459. At this point, strap 474 is folded inward over flap 452 to allow hook and loop fastening means 478 to mate with hook and loop fastening means 455 to securely retaining weight means 470 within pocket member 450, but also allowing weight means to be rapidly removed in an emergency situation.

To remove weight means 470 the diver grabs handle means 480 at gripping surface 484 and pulls handle means 480 with a normal tugging motion force, nearly simultaneously breaking the attachment of fastening means 478 to fastening means 455, fastening means 458 to fastening means 462, fastening means 476 to fastening means 458 and fastening means 480 to fastening means 462, allowing weight means 470 to be rapidly removed from pocket members 450. Once removed, weight means 470 can be dropped by the diver and thus the diver does not lose the entire belt in the emergency situation. Furthermore, if time permits, the diver can remove the weight bag from pouch 472 and simply drop the weight bag, thus only losing the weight bag which comprises the majority of the weight of weight means 470.

It should be recognized that pocket member 450 and weight means 470 can also be utilized with body member 12, and likewise pocket member 70 and weight means 90 can also be utilized with body member 300. Furthermore, clip means 50, including female receiving member 52, male insertion member 54 and strap 56 can also be utilized with body member 300, and likewise male insertion member 500, female receiving member 502 and elastic section 504 can also be utilized with body member 12.

Figures 8, 9A, 9B, 9C:
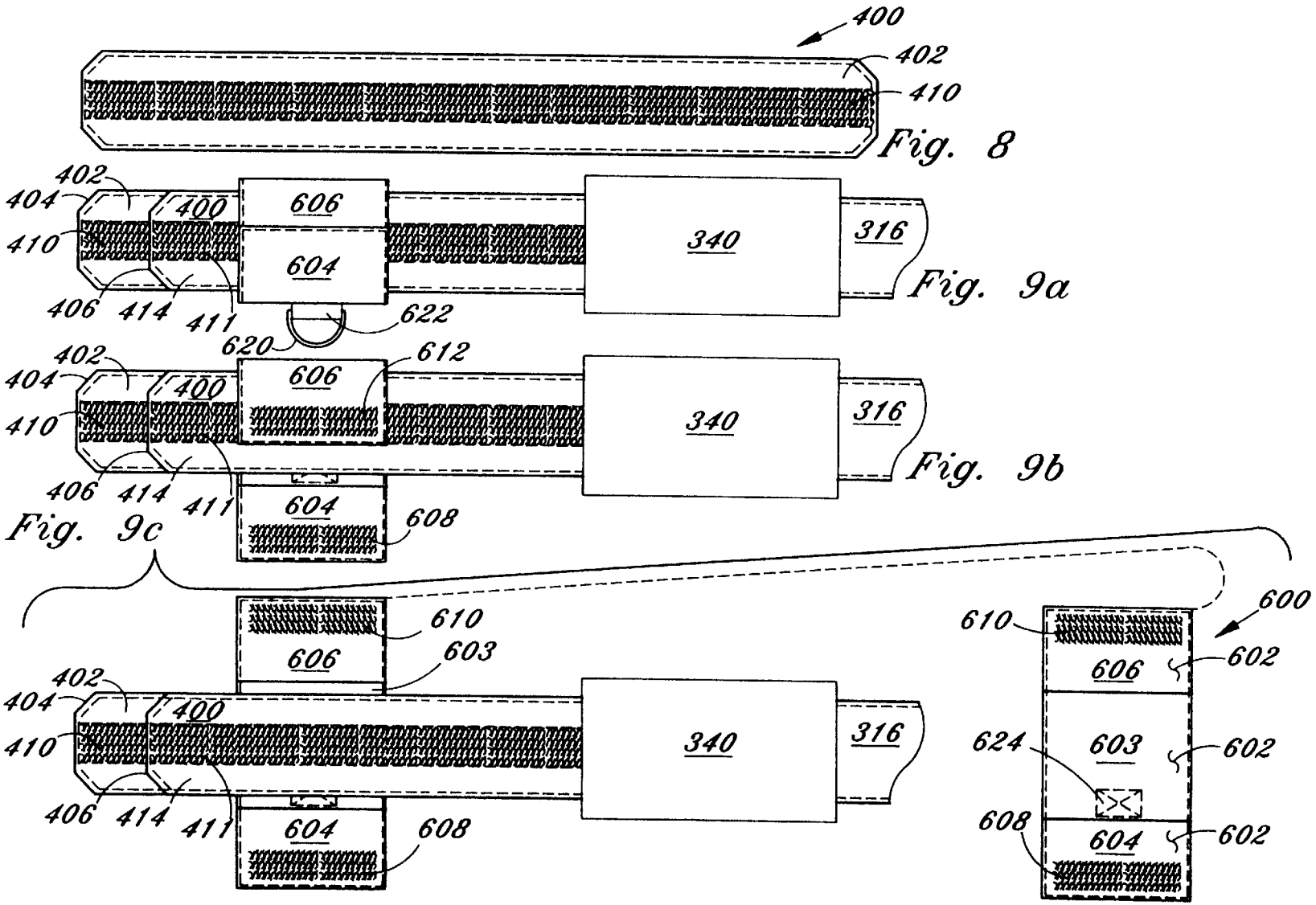
FIG. 8 is a front elevational view of the interior side of the adjustable section of the second embodiment body member illustrating a single hook and loop fastening means.
FIGS. 9*a* is a front elevational view of the interior side of a portion of the second embodiment body member illustrating a removable and adjustable pocket member attached to the adjustable section of the second embodiment body member.
FIG. 9*b* is a front elevational view of the interior side of a portion of the second embodiment body member illustrating the first step for adjusting the adjustable pocket member along the adjustable section of the second embodiment body member.
FIG. 9*c* is a front elevational view of the interior side of a portion of the second embodiment body member illustrating the second step for adjusting the adjustable pocket member along the adjustable section of the second embodiment body member and also showing the adjustable pocket member removed from the adjustable section of the second embodiment body member.

FIGS. 9*a* through 9*c* illustrate a removable and adjustable pocket member 600 which is attached to adjustable section 400, as described above, and replaces pocket member 450 which is permanently attached to adjustable section 400. The quick release weight means described above is associated with pocket member 600. The quick release weight means is not shown for purposes of FIGS. 9*a* through 9*c*, as these Figures illustrate the removable and adjustable features of pocket member 600 to adjustable section 400. However, it is to be understood that the quick release weight means (including a pouch member, weight bag, handle means, etc, rapid release retaining means), described above, is associated with pocket member 600. Furthermore, pocket member 600 also has a pouch receiving area and flap member, having hook and loop fastening means disposed thereon, which are also not shown for purposes of FIGS. 9*a* through 9*c*, but are similar to like features for pocket member 70 or 450 described above.

Pocket member 600 includes an interior surface 602 and has a first flap member 604 and a second flap member 606. Flap member 604 includes a hook and loop fastening member 608 disposed a first side, while second flap member 606 has a first hook and loop fastening member 610 disposed on a first side and a second hook and loop fastening member 612 disposed on a second side. A miscellaneous or utility D-ring member 620 can be attached to pocket member 600, preferably middle member 602, by conventional means, such as strap or fabric material 622 and stitching 624.

Before removably attaching pocket member 600 to adjustable section 400, adjustable section 400 is properly attached and positioned with respect to the remaining portion of body member 300. When attaching pocket member to adjustable section 400, pocket member 600 is first properly positioned along adjustable section to ensure that pocket member 600 and pocket member 450 on fixed section 316 are properly aligned and center forward the diver's hip area and just above the diver's waist area, when body member 300 is properly attached around the diver's waist area. This helps the diver to remain balanced at depth as pocket member 600 and pocket member 450, with their respective rapid release weight means, are opposing and equally align. Thus, as adjustable section 400 can be adjusted or repositioned depending on the waist size of the diver, associated pocket member 600 is adjusted or repositioned with adjustments to section 400 to maintain pocket member 600 in its equally align position with pocket member 450.

Once pocket member 600 is properly positioned along adjustable section 400 (FIG. 9*c*), flap member 606 is folded inward over adjustable section 400 to allow hook and loop fastening means 610 to mate with hook and loop fastening member 411 disposed on outer surface 414 of adjustable section 400 (FIG. 9*b*). This mating connection, prevents pocket member 600 from sliding along adjustable section 400 and out of proper position. After such, flap member 604 is folded inward over attached flap member 606 to allow hook and loop fastening means 608 to mate with hook and loop fastening member 612 disposed on flap member 606 (FIG. 9*a*). When body member 300 is attached around the waist of the diver, flap member 604 and flap member 606 abut against the diver's body to ensure that the attachment of flap members 604 and 606 to each other is not inadvertently or accidentally broken.

To reposition the attached pocket member 600 (FIG. 9*a*), flap member 604 is disconnected from its attachment to flap member 606, by breaking the connection of hook and loop fastening means 608 and 612, from each other (FIG. 9*b*). Next flap member 606 is disconnected from its Attachment to adjustable section 400, by breaking the connection of hook and loop fastening means 411 and 610, from each other (FIG. 9*c*), thus freeing pocket member 600 from adjustable section 400.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A dive belt, comprising:

a body member having a first end and a second end, said body member attached to a body area of a diver;

means for removably securing said first end of said body member to said second end of said body member for maintaining the attachment of said body member to the body area of the diver;

at least one weight means removably secured to said body member; and means for quickly releasing said weight means from said body member;

wherein said body member adapted to remain attached to the body area after said weight means are released;

wherein said means for quickly releasing comprises:

(a) a pocket member having an open end and attached to said body member, said pocket member having a flap member associated with the open end, said weight means disposed within said pocket member;

(b) means for removing said weight means, a portion of said means for removing extending out of said pocket member, said flap member folded over a segment of the portion of said means for removing and removably attached to said pocket member.

2. The dive belt of claim 1 further including means for horizontally mounting a compressed gas cylinder to said body member.

3. The dive belt of claim 1 further including means for maintaining a tight attachment of said body member to the body area when the diver travels to various depths underwater.

4. The dive belt of claim 3 wherein said means for maintaining is an elastic member disposed between said first section and said section of said body member, said elastic member having a first end and a second end and expanding or compressing with underwater diver depth changes.

5. The dive belt of claim 4 wherein said body member further including a sleeve member, wherein said elastic member disposed within said sleeve member, the first end of said first section attached to the first end of said elastic member and the second end of said elastic member and the first end of said second section attached to said sleeve member, wherein said second section adapted to remain fixed around the diver's waist and adjacent back area and said first section moves with the expansion or compression of said elastic member to maintain a tight relationship of said body member around the waist and adjacent back area of the diver.

6. The dive belt of claim 1 wherein said means for removing comprises a strap member associated with said weight means; and a gripping member attached to a first end of said strap member.

7. The dive belt of claim 6 wherein said means for removing further comprising a pouch member, said weight means disposed within said pouch member, said pouch member disposed within said pocket member, a second end of said strap member attached to said pouch member.

8. The dive belt of claim 7 wherein said means for removing further comprising a second flap member associated with said pocket member, said second flap member folded over at least a portion of said gripping member and removably attached to said pocket member.

9. A dive belt adapted to be disposed around a waist and adjacent back area of a diver and for use in underwater activities, comprising:

a body member having a first section and a second section, said first section having a first end and a second end, said second section having a first end and a second end, said first end of said first section and said first end of said second section operatively associated with each other, said first section having an exterior section and an interior section, said second section having an exterior section and an interior section;

means for removably attaching said second end of said first section to said second end of said second section;

a first pocket member attached to the exterior section of said first section;

a second pocket member attached to the exterior section of said second section;

a first weight means disposed within said first pocket member;

a second weight means disposed within said second pocket member;

first quick release means for rapidly removing said first weight means from said first pocket member;

second quick release means for rapidly removing said second weight means from said second pocket member;

wherein said body member adapted to remain attached around the waist and adjacent back area of the diver after said weight means are released;

means for maintaining a tight fit of said body member around the waist and adjacent back area when the diver travels to various depths underwater;

wherein said means for maintaining is an elastic member disposed between said first section and said section of said body member, said elastic member having a first end and a second end and expanding or compressing with underwater diver depth changes;

wherein said body member further including a sleeve member, wherein said elastic member disposed within said sleeve member, the first end of said first section attached to the first end of said elastic member and the second end of said elastic member and the first end of said second section attached to said sleeve member, wherein said second section adapted to remain fixed around the diver's waist and adjacent back area and said first section moves with the expansion or compression of said elastic member to maintain a tight relationship of said body member around the waist and adjacent back area of the diver.

10. A depth compensating device for use with an article worn by a diver when submerging in water and during other underwater activities, said article having a body member, said depth compensating device comprising:

an elastic member adapted to be disposed between a first section and a section of said body member of said article, said elastic member expanding or compressing with underwater diver depth changes;

a sleeve member, said elastic member disposed within said sleeve member;

wherein a first end of the first section attached to the first end of said elastic member and a second end of said elastic member and a first end of the second section attached to the said sleeve member.

11. A device for quickly releasing a weight member from an article worn by a person, said article having a body member, said device comprising:

a weight member;

a pocket member having an open end and adapted to be attached to said body member, said pocket member having a flap member associated with the open end, said weight member disposed within said pocket member; and means for removing said weight means, a portion of said means for removing extending out of said pocket member, said flap member folded over a segment of the portion of said means for removing and removably attached to said pocket member.

12. The device of claim 11 wherein said means for removing comprises a strap member associated with said weight member; and a gripping member attached to a first end of said strap member.

13. The device of claim 12 wherein said means for removing further comprising a pouch member, said weight member disposed within said pouch member, said pouch member disposed within said pocket member, a second end of said strap member attached to said pouch member.

14. The device of claim 13 wherein said means for removing further comprising a second flap member associated with said pocket member, said second flap member folded over at least a portion of said gripping member and removably attached to said pocket member.

15. A dive belt, comprising:

a body member having a first end and a second end, said body member attached to a body area of a diver;

means for removably securing said first end of said body member to said second end of said body member;

at least one weight means removably secured to said body member and positioned on said body member for rapid removement; and means for quickly releasing said weight means from said body member;

wherein said body member adapted to remain attached to the body area after said weight means are released;

wherein said means for quickly releasing comprises a pocket member attached to said body member and means for removing said weight means; said pocket member adapted to remain attached to said body member after said weight means are released.

16. The dive belt of claim 15, further including means for towing attached to said body member.

* * * * *